US007797897B2

(12) United States Patent
Roth

(10) Patent No.: US 7,797,897 B2
(45) Date of Patent: Sep. 21, 2010

(54) BUILDING CONSTRUCTION ASSEMBLY OF STRUCTURAL MODULES

(75) Inventor: Jonathan Roth, Pardes-Hana (IL)

(73) Assignee: Dynamic Shells Ltd, Petach Tiqva (IL)

( * ) Notice: Subject to any disclaimer, the term of this patent is extended or adjusted under 35 U.S.C. 154(b) by 616 days.

(21) Appl. No.: 10/505,558

(22) PCT Filed: Feb. 26, 2003

(86) PCT No.: PCT/IL03/00149

§ 371 (c)(1),
(2), (4) Date: Aug. 23, 2004

(87) PCT Pub. No.: WO03/072884

PCT Pub. Date: Sep. 4, 2003

(65) Prior Publication Data

US 2005/0091932 A1 May 5, 2005

(30) Foreign Application Priority Data

Feb. 26, 2002 (IL) ..... 148400

(51) Int. Cl.
*E04B 1/38* (2006.01)

(52) U.S. Cl. ..... 52/282.3; 52/79.1; 52/270; 52/429; 52/588.1

(58) Field of Classification Search ..... 52/220.1, 52/220.2, 220.3, 220.5, 220.7, 275, 421, 52/427, 431, 429, 563, 438, 284, 588.1, 508.1, 52/718.04, 738.1, 737.6, 582.1, 439, 499, 52/433, 282.1, 282.2, 309.15, 586.1, 586.2, 52/590.2, 766, 773, 780, 781, 592.1, 763, 52/293.3, 270, 271, 300, 79.1, 282.3, 736.6
See application file for complete search history.

(56) References Cited

U.S. PATENT DOCUMENTS 1,958,124 A 5/1934 Bemis (Continued)

FOREIGN PATENT DOCUMENTS

EP 0 382 084 8/1990

(Continued)

*Primary Examiner*—Richard E Chilcot, Jr.
*Assistant Examiner*—Chi Q Nguyen
(74) *Attorney, Agent, or Firm*—The Nath Law Group; Derek Richmond; Sung Yeop Chung

(57) ABSTRACT

A building construction assembly composed of factory-manufactured thermoplastic structural modules which when interconnected at a building site then create the entire shell of an edifice having side walls and a roof. Each module which is formed of a pair of parallel panels bridged by transverse webs is provided on either side along its length with a pair of flexible catch flanges projecting from the panels. When assembling these modules to create the shell of the edifice, adjacent modules are interconnected in coplanar relation by a double-faced joiner on each face of which is a pair of teeth. When one face of the joiner is pressed against a side of a module, its catch flanges then flex to snap into and behind the teeth to connect the joiner to this module. The other face of the joiner is similarly connected to the side of an adjacent module whereby the modules are then interconnected in coplanar relation. When it becomes necessary to interconnect four modules in a cross formation, use is then made of a square, quad-faced joiner on each face of which are a pair of teeth which are engageable by the catch flanges projecting from the side of the module to be joined to this face.

12 Claims, 3 Drawing Sheets

U.S. PATENT DOCUMENTS 2,682,938 A * 7/1954 MacDonald ..... 52/590.2
3,348,459 A * 10/1967 Harvey ..... 404/35
3,712,005 A * 1/1973 Eschbach et al. ..... 52/210
3,992,839 A 11/1976 La Borde
4,196,555 A 4/1980 Henges, Jr. et al.
4,557,091 A * 12/1985 Auer ..... 52/282.3
5,201,159 A 4/1993 Göranson et al.
5,247,773 A 9/1993 Weir
5,609,435 A * 3/1997 Nomura ..... 403/387
5,706,620 A 1/1998 De Zen
5,729,944 A 3/1998 De Zen
5,735,090 A * 4/1998 Papke ..... 52/220.2
5,953,880 A * 9/1999 De Zen ..... 52/737.6
5,974,751 A 11/1999 De Zen
6,189,269 B1 * 2/2001 De Zen ..... 52/220.5
6,295,778 B1 * 10/2001 Burt ..... 52/592.6
6,739,106 B2 * 5/2004 Curatolo ..... 52/592.1
6,993,802 B1 * 2/2006 Hone ..... 14/71.5

FOREIGN PATENT DOCUMENTS

EP 0 558 767 9/1993
WO 86/05224 9/1986

* cited by examiner

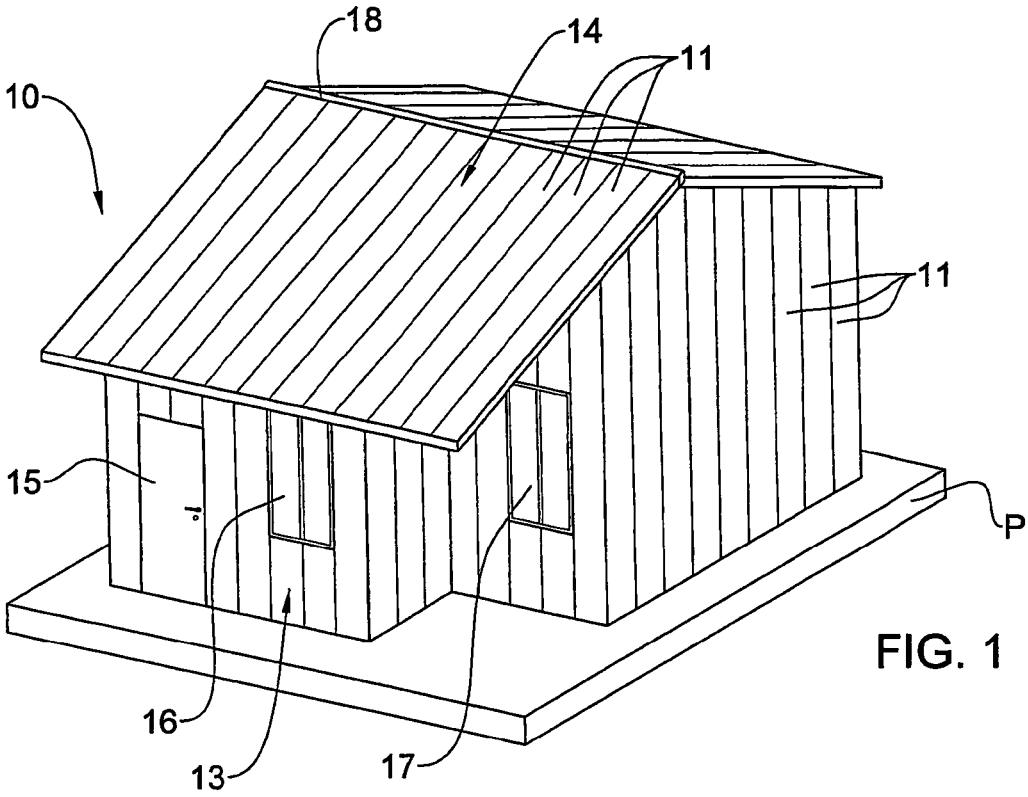
FIG. 1
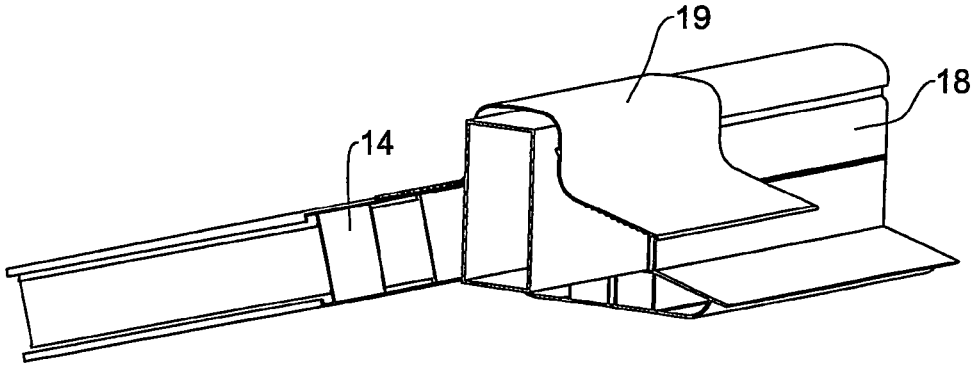
FIG. 2
FIG. 3
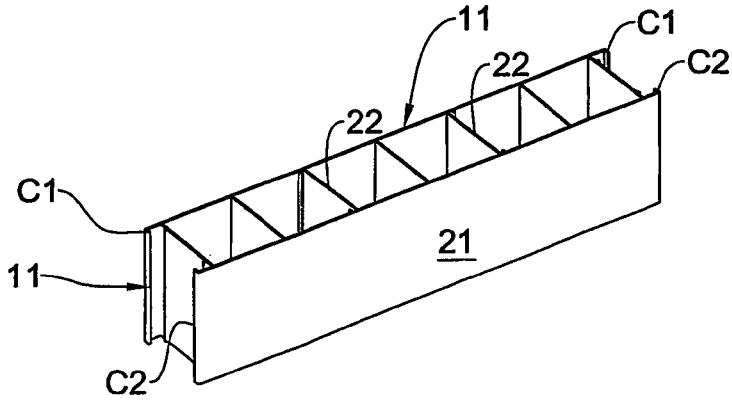

BUILDING CONSTRUCTION ASSEMBLY OF STRUCTURAL MODULES

BACKGROUND OF THE INVENTION

1. Field of the Invention

This invention relates generally to a building construction assembly composed of plastic structural modules which are interconnectable to create the shell of a residential or other edifice, and in particular to an assembly of this type in which the modules are interconnected by snap-in joiners to create the walls of the shell.

2. Status of Prior Art

The need for low cost housing that is available on short notice becomes most pressing when there is an influx of people into a community who are in search of such housing but cannot afford the cost of standard housing, nor can they wait out the prolonged period it normally takes to construct a standard house.

Such a situation arose at the conclusion of World War II when thousands of veterans returned to their towns and villages to rejoin or acquire wives and to find a suitable residence for their families. U.S. Pat. No. 1,958,124 is addressed to this situation, for it discloses a building construction assembly composed of factory-manufactures block-like hollow steel modules which when interconnected at a building site create the basic shell of a livable residence.

But the commercial acceptance of a construction assembly of steel modules was not widespread, for it was discouraged by the need to weld together a multitude of such modules. This requirement added substantially to the cost of erecting the steel shell of the edifice and the time it took to do so.

Of greater prior art interest is the 1999 U.S. Pat. No. 5,729,944 to De Zen which deals with an assembly of interconnectable thermoplastic structural components, adapted to create the shell of an edifice, as does a construction assembly in accordance with the present invention.

The structural components disclosed in the De Zen patent are each provided along its length with grooves adapted to mate with interlocking flanges of a box connector serving to interconnect adjacent components. A serious drawback of the De Zen arrangement is that it is necessary to slide the elongated structural components into the box connectors and it is difficult to do so at a building site. Also of prior art interest are De Zen U.S. Pat. Nos. 5,706,620 and 5,974,751 which show construction assemblies similar to those in the De Zen '944 Patent.

There are known also building structures disclosed in U.S. Pat. 5,247,773. In this patent are described modular structural components extruded from plastic. The structures are used for building a wall, ceiling, roof etc. The structures can be connected by virtue of male and female means provided on the middle of short, transversal walls of the modules. For this purpose the male component of one module has resilient flanges that can be forced into a corresponding female slot of the adjacent module. Relevant to the present invention is the embodiment shown in FIG. 9,10 depicting a dedicated joiner consisting of two male locking protrusions facing in opposite directions and adapted for insertion into corresponding female depressions made in the modules. The disadvantage of this solution lies in the fact that relatively high forces should be applied to join the modules, since the force is to be applied perpendicularly to the transversal wall of the module and it should be sufficient to deflect both resilient flanges of the male component, the outcome of which is that assembly becomes complicated and inconvenient. This renders the assembling complicate and inconvenient. Furthermore, the disposition of the female depressions on the middle of the transverse wall allows to join the modules merely in side-by-side relationship and not in a cross relationship.

SUMMARY OF THE INVENTION

In view of the foregoing, the main object of this invention is to provide a building construction assembly composed of factory-manufactured thermoplastic modules capable of being interconnected quickly and without difficulty at a building site to erect the permanent shell or framework of a residential structure or other edifice.

More particularly, an object of the invention is to provide a building construction assembly of the above type in whose modules are interconnected by snap-in double-faced and quad-faced joiners, the modules being joined together simply by a snap-in action.

Among the significant advantages of this invention are the following:

1st. The snap-in joiners obviate the difficulties encountered in prior art assemblies in which it is necessary to slide the modules with respect to their joiners in order to interconnect them, whereby assembly and erecting of a structure substantially does not require applying force or using tools;

2nd. The snap-in joiners interconnect the modules so that no free spaces exist therebetween in walls constructed of these modules, and further, the joiners are concealed between adjoining modules;

3rd. The snap-in joiners facilitate the erection of the complete edifice shell at a building site, even a complex edifice, in a matter of hours, rather than days or weeks;

4th. The cost of erecting an edifice shell by interconnecting modules by means of snap-in joiners is relatively low, yet the interconnections are strong and durable;

5th. A shell created by interconnected modules in accordance with the invention can readily be anchored on a ground pad at a building site, making it possible thereafter to quickly complete the internal structure of the edifice.

Briefly stated, these objects are attained in a building construction assembly composed of factory-manufactured thermoplastic structural modules which when interconnected at a building site then create the entire shell of an edifice having side walls and a roof. Each module is formed by a pair of parallel panels bridged by transverse webs and provided on either side along its length with a pair of flexible catch flanges projecting from the panels.

When assembling these modules to create the shell of the edifice, adjacent modules are interconnected in coplanar relation by a double-faced joiner; on each face of which is a pair of teeth. When one face of the joiner is pressed against the side of a module, its catch flanges then flex to snap into and behind the teeth to connect the joiner to this module. The other face of the joiner is similarly connected to the side of an adjacent module whereby the modules are then interconnected in coplanar relation.

When it becomes necessary to interconnect four modules in a cross formation, use is then made of a square quad-faced joiner on each face of which is a pair of teeth to engage the catch flanges of the module joined to this face.

BRIEF DESCRIPTION OF THE DRAWINGS

For a better understanding of the invention as well as other objects and features thereof, reference is made to the annexed drawings wherein:

FIG. 1 is a perspective view of a one-story residence constructed on a building site, the shell of which is formed from an assembly of interconnected plastic modules in accordance with the invention;

FIG. 2 illustrates the keel of the gable roof of the building shown in FIG. 1;

FIG. 3 illustrates one of the modules included in the assembly;

DETAILED DESCRIPTION OF THE INVENTION

Figure 4:
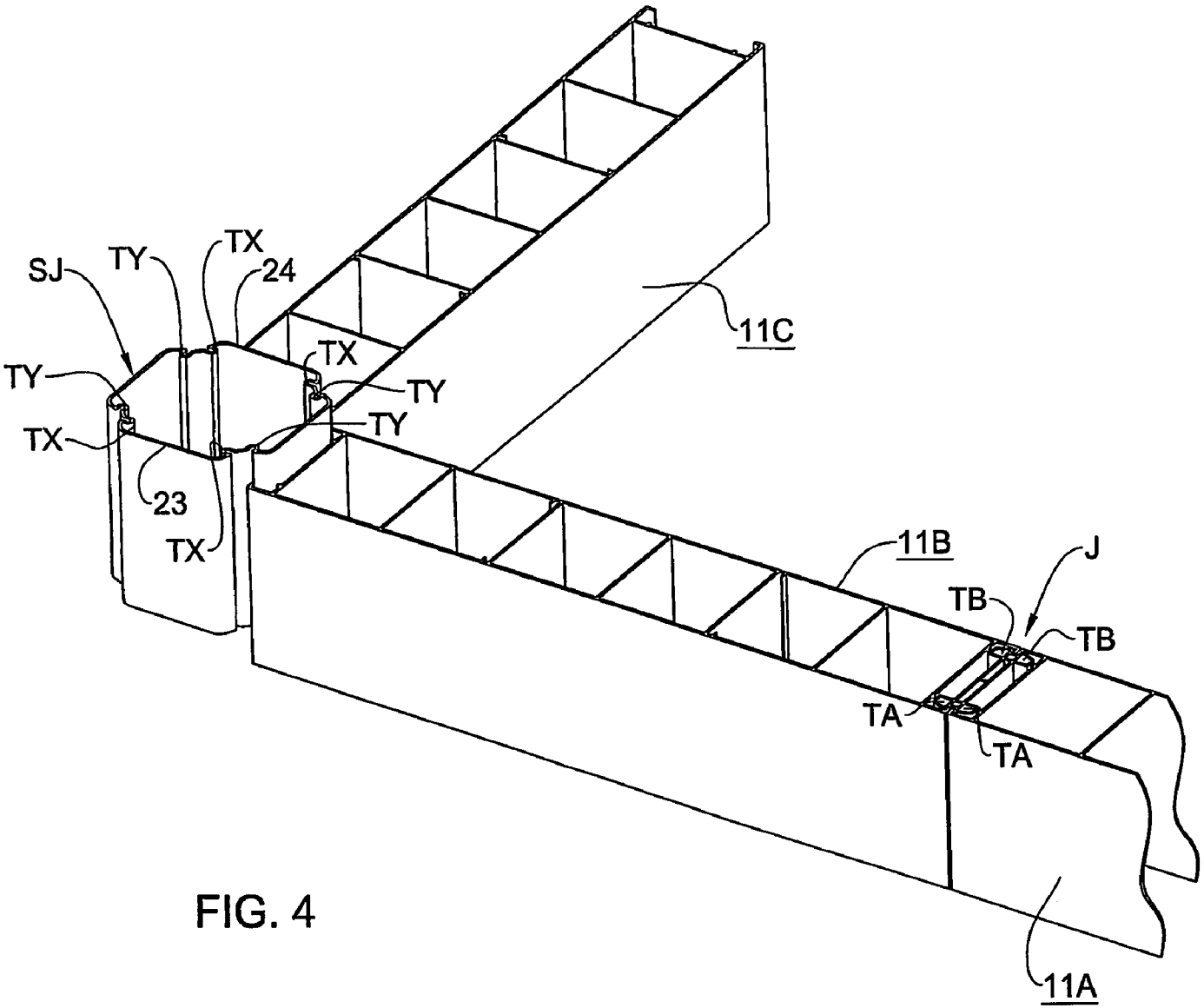
FIG. 4 is a quad-faced square joiner connecting the second module to a third module at right angles thereto.

Referring now to FIGS. 1 and 2 of the drawings, shown therein is a one-story house 10 suitable as a family residence, the shell of which defines the walls and roof of the house. The shell is erected at a building site by interconnecting an assembly of structural modules 11 in accordance with the invention.

These modules are factory-manufactured on a mass production basis to produce an assembly of modules appropriate to the architecture of the edifice. The assembly is then shipped to the building site at which it is only necessary to interconnect the modules 11 to erect the side walls 12 and 13 of the house and its gabled roof 14. The modules forming the walls are structured to provide rectangular openings to accommodate a door 15 and windows 16 and 17.

The gabled roof 14 is formed by interconnected modules 11 forming angled sides at whose peak is a keel 18. Overlying keel 18 and covering its junctions with the angled sides of the roof is a flashing 19 which serves to waterproof the roof.

The shell of house 10 is anchored by anchor rods or other means to a rectangular concrete ground pad P. The architecture of house 10 illustrated in FIGS. 1 and 2 is by way of example only. In practice, the assembly of modules may be tailored to create an edifice of any design having side walls which are vertical, horizontal or angled. When a colony of prefabricated houses is planned, each erected by an assembly of modules in accordance with the invention, it is then desirable that the houses in the colony have different design to avoid regimentation and to provide a more natural community.

Each module 11, as shown in FIG. 3 is extruded of high-strength thermoplastic material such as PVC, polyethylene or polycarbonate in the manner disclosed in the above-identified De Zen patents. In practice, the plastic material may be fiber-reinforced by glass, carbon or other fibers which act to strengthen the module.

Module 11 consists of parallel panels 20 and 21 bridged by a row of equispaced transverse webs 22 integral with the panels to form a light-weight structure highly resistant to compressive and bending forces. Because the modules are not heavy, they are easy to handle at the construction site. The space between transverse webs 22 may be filled with foamed thermal isolating material or may including wiring and other installations of the constructions.

The air space between the panels when the modules are interconnected to form a wall may be used to accommodate electrical wiring or plumbing pipes. The entrapped an space imparts thermal insulation properties to the wall.

Extending from the opposite ends of module panels 20 and 21 are flexible catch flanges C1 and C2 which run the full length of the module and are provided with bent-in catches. Flanges C1 and C2 project beyond the webs 22 at the opposite ends of the web row, and because the catch flanges are flexible, they can be deflected in the manner to be later explained to catch onto the teeth of a module joiner.

Figure 5:
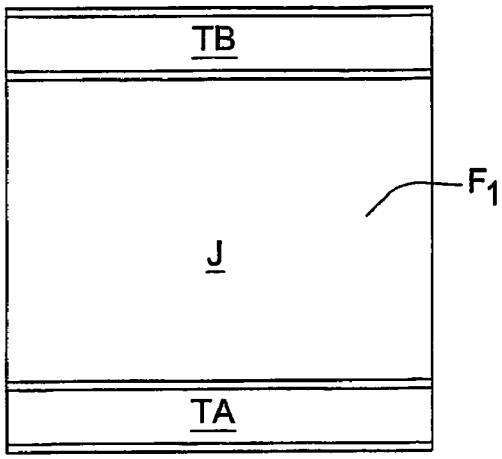
FIG. 5 is an end view of the double-faced joiner.
Figure 6:
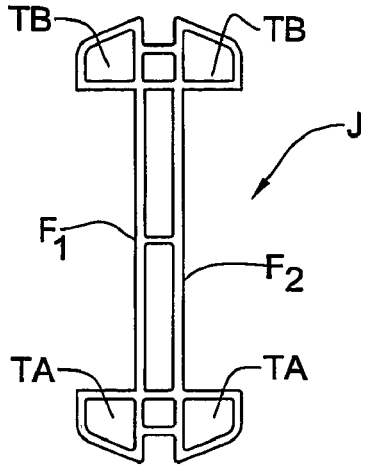
FIG. 6 a plan view of a double-faced joiner for interconnecting adjacent modules in coplanar relation.

To join adjacent modules 11A and 11B which are in line with each other so that they are in coplanar relation, there is provided, as shown in FIGS. 4, 5 and 6, a double-faced joiner J having a pair of opposing rectangular faces F1 and F2. Projecting from face F1 is a pair of parallel teeth TA and TB having a trapezoidal cross section, only the outer side of the teeth being sloped to function as a ramp. Projecting from face F2 which is opposite face F1 is a like pair of teeth TA and TB.

Figure 7:
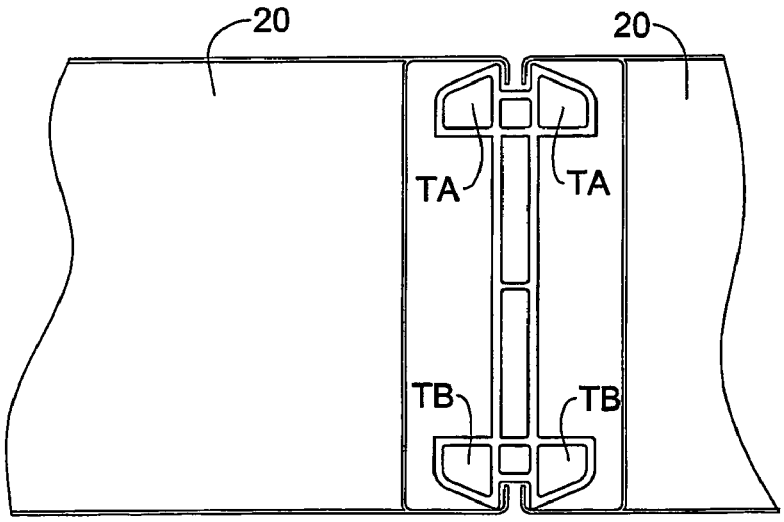
FIG. 7 illustrate how the joiner interconnects adjacent modules.

The dimensions of double-faced joiner J complement those of the modules 11A and 11B to be interconnected. Hence when face F1 of joiner J is pressed against the side of module 11A, its projecting teeth TA and TB engage catch flanges C1 and C2 on the side of this module, causing the flanges to flex and snap into and behind the teeth and thereby connect joiner J to module 11A. And when face F2 of joiner J is pressed against the side of the adjacent module 11B to connect the joiner thereto, modules 11A and 11B are then interconnected in a side-by-side, coplanar relation as shown in FIG. 7.

When the modules are interconnected by double-faced joiner J, the double-faced joiner J is then confined within the space between the end webs 22 of the adjacent modules as shown in FIG. 4. Hence there is no free space between the modules when they are interconnected to form a planar wall of the edifice.

Figure 8:
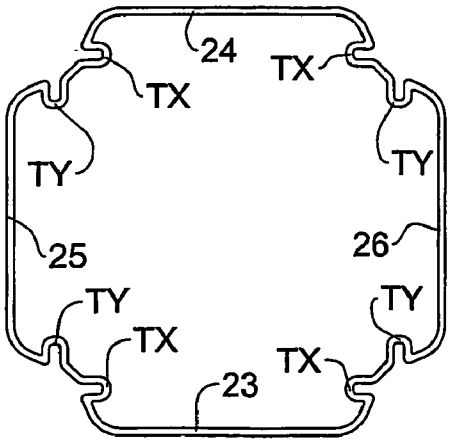
FIG. 8 is a plan view of the quad-faced square joiner.

When it is necessary to join a planar wall to another planar wall at right angles thereto, then as shown in FIGS. 4 and 8, one must use for this purpose a four-faced square joiner SJ each rounded corner of which is defined by a pair of teeth TX and TY at right angles to each other. Thus the opposing parallel faces 23 and 24 of the quad-faced square junction SJ are each provided with a pair of teeth TX, while the opposing parallel faces 25 and 26 which are at right angles to faces 23 and 24 and are each provided with a pair of teeth TY.

Snapping into the pair of teeth in each face of square joiner SJ are the flexible catch flanges C1 and C2 extending from the side of a module. Thus FIG. 4 shows a third module 11C joined to a face of square junction SJ so that it is at right angles to the second module 11B. A fourth module (not shown) can be joined to the face 25 of the junction so that it too is at right angles to the third module, and a fifth module (not shown) can be joined to face 23 so that it is in line with the second module. Thus when modules are connected to all four faces of the square joiner SJ they are in symmetrical cross formation.

The double-faced and four-faced make it possible to create the shell of an edifice having planar walls at right angles to each other. If the geometry of the shell is such as to require a joiner for providing an acute angle between one wall and another, the four-faced joiner for this purpose then has an appropriate parallelogram shape.

While there has been shown an assembly of interconnectable modules for erecting the shell of an edifice, it is to be understood that many changes may be made therein without departing from the scope of the invention as defined by the appended claims. Thus the modules, instead of being extruded of thermoplastic material may be formed of extruded aluminum.

The invention claimed is:

1. A building construction system, comprising:

a group of modules, which are interconnectable to create a shell of an edifice, each module in the group comprising a pair of parallel lateral longitudinal panels having opposite ends, each lateral panel terminates at either of the opposite ends thereof with a flexible catch region comprising a long portion and a short, bent-in portion, and at least one transversal web, wherein said lateral panels are bridged by the at least one transversal web extending between the panels, and a joiner for interconnecting modules in the group, the joiner having at least two faces detachably connectable to the opposite ends of the module, and a face of the joiner comprises a pair of teeth wherein each tooth in the pairs of teeth has a cross section having a first side and a second side, the first and the second sides being perpendicular to each other and having a third side in a slanting relationship to both the first side and to the second side such that, when the face of the joiner is pressed against the catch region of the module, the long portion flexes and the bent-in portion snaps into and behind the teeth to connect an opposite end of the module to the joiner.

2. The system as set forth in claim 1, wherein the joiner has two opposite faces, either of which is provided with a pair of teeth adapted to interconnect two modules in a side-by-side, coplanar relationship.

3. The system as in claim 2, wherein said teeth have a trapezoidal cross section with one sloping side, which, when engaged by either of said catch regions, is adapted to urge the long portion of the catch region to flex and the bent-in portion to snap behind the teeth.

4. The system as set forth in claim 1, wherein the joiner has four faces arranged in a square formation, said faces are adapted to interconnect four modules in a cross relationship.

5. The system as set forth in claim 1, wherein the modules are made in a factory and are adapted to be joined together at a building site to create the shell.

6. The system as set forth in claim 5, wherein the modules, when interconnected, are adapted to create an edifice shell having walls and a roof.

7. The system as set forth in claim 5, wherein each module is formed of a thermoplastic material.

8. The system as set forth in claim 7, wherein the thermoplastic material is extruded to define a pair of parallel lateral panels and a row of transverse webs bridging the panels.

9. The system as set forth in claim 8, wherein either of said catch regions extends from the respective lateral panel and is integral therewith.

10. The system as set forth in claim 9, wherein the long portion of either of the catch regions is flush with the respective lateral panel.

11. The system as set forth in claim 1, wherein the shell of the edifice is anchored on a concrete pad at a building site.

12. A building construction system comprising:

a group of modules interconnectable to create a shell of an edifice, each module in the group comprising a pair of parallel lateral longitudinal panels having opposite ends, the lateral panels comprising at least one transversal web extending between the panels for bridging the lateral panels, a joiner for interconnecting modules in the group, the joiner comprising at least two faces detachably connectable to the opposite ends of the module wherein each lateral panel terminates at either of the opposite ends thereof with a flexible catch region comprising a long portion and a short, bent-in portion and, either face of the joiner is provided with a pair of teeth wherein each of said pair of teeth comprises in cross-section an outer side oriented in a slanting relationship with respect to the face such that, when the face of the joiner is pressed against either of the catch regions of the module to urge the long portion to flex and the bent-in portion to snap into and behind the teeth and thus to connect either of opposite ends of the module to the joiner.

* * * * *